US008168946B2

(12) United States Patent
Narushima et al.

(10) Patent No.: US 8,168,946 B2
(45) Date of Patent: May 1, 2012

(54) CHARGED PARTICLE SEPARATION APPARATUS AND CHARGED PARTICLE BOMBARDMENT APPARATUS

(75) Inventors: Masaki Narushima, Nirasaki (JP); Koichi Mori, Tokyo (JP); Isao Yamada, Kobe (JP); Noriaki Toyoda, Kobe (JP)

(73) Assignees: Tokyo Electron Limited, Tokyo (JP); Hyogo Prefecture, Hyogo (JP)

( * ) Notice: Subject to any disclaimer, the term of this patent is extended or adjusted under 35 U.S.C. 154(b) by 147 days.

(21) Appl. No.: 12/816,512

(22) Filed: Jun. 16, 2010

(65) Prior Publication Data

US 2010/0320380 A1 Dec. 23, 2010

(30) Foreign Application Priority Data

Jun. 19, 2009 (JP) ..... 2009-146766

(51) Int. Cl.
*H01J 49/28* (2006.01)
*H01J 3/26* (2006.01)

(52) U.S. Cl. ..... 250/294; 250/396 R

(58) Field of Classification Search ..... 250/281–282, 250/290, 294, 396 R, 397
See application file for complete search history.

(56) References Cited

FOREIGN PATENT DOCUMENTS

| | | | |
|---|---|---|---|
| JP | 7-85834 A | | 3/1995 |
| JP | 07085834 A | * | 3/1995 |
| JP | 2005-071642 | | 3/2005 |
| JP | 2005-085538 A | | 3/2005 |
| JP | 2005071642 A | * | 3/2005 |

OTHER PUBLICATIONS

Japanese Office Action mailed Apr. 12, 2011.
Chinese Office Action mailed Aug. 31, 2011.

* cited by examiner

*Primary Examiner* — Jack Berman
*Assistant Examiner* — David E Smith
(74) *Attorney, Agent, or Firm* — IPUSA, PLLC

(57) ABSTRACT

A charged particle separation apparatus that separates ionized gas clusters is disclosed. The charged particle separation apparatus includes an electric field applying part including two electrodes across which electric voltage is applied in order to generate electric field between the two electrodes thereby deflecting a trajectory of the ionized gas cluster, the electrodes including one of an opening and a void; and a plate opening that allows the ionized gas cluster whose trajectory is deflected by the electric field applying part to go therethrough.

7 Claims, 9 Drawing Sheets

CHARGED PARTICLE SEPARATION APPARATUS AND CHARGED PARTICLE BOMBARDMENT APPARATUS

CROSS-REFERENCE TO RELATED APPLICATION

The present application contains subject matter related to Japanese Patent Application No. 2009-146766 filed with the Japanese Patent Office on Jun. 19, 2009, the entire contents of which are incorporated herein by reference.

BACKGROUND OF THE INVENTION

1. Field of the Invention

The present invention relates to a charged particle separation apparatus and a charged particle bombardment apparatus.

2. Description of the Related Art

Gas clusters into which plural atoms and the like are condensed exhibit a unique physicochemical behavior, and attract attention for applications in various fields of technologies. Namely, gas cluster ion beams are thought to be applicable for processes such as ion-implantation, surface machining, and thin film deposition in a depth range of several nanometers from a surface of a solid material, while the processes in such a depth range have been considered difficult by conventional technologies.

In a gas cluster generating apparatus, it is possible to generate gas clusters formed of several hundred through several thousand atoms from a compressed gas supplied from a gas supplying source. The number of the atoms in the gas cluster generated by the gas cluster generating apparatus is stochastically-distributed, and thus the gas clusters range in mass. The gas clusters need to be separated depending on the masses of the gas clusters in practical use.

To this end, a method has been proposed in order to separate the gas clusters generated by the gas cluster generating apparatus depending on the masses (Patent Document 1).

Patent Document 1: Japanese Patent Application Laid-Open Publication No. 2005-71642.

The method of separating ionized gas clusters, which is described in Patent Document 1, employs two plate-like electrodes arranged in parallel with each other, and applies electric fields between the two plate-like electrodes in order to separate ionized gas clusters.

When the gas clusters collide against the plate-like electrodes, they may be decomposed, which causes an increase in pressure between the plate-like electrodes. As a result, pressures become different in areas near the plate-like electrodes from areas away from the plate-like electrodes, which may affect separation performance of the ionized gas clusters.

The present invention has been made in view of the above, and provides a charged particle separation apparatus and a charged particle bombardment apparatus that enable appropriate separation of ionized gas clusters depending on a mass or a valence of the ionized gas clusters.

SUMMARY OF THE INVENTION

A first aspect of the present invention provides a charged particle separation apparatus that separates ionized gas clusters. The charged particle separation apparatus includes an electric field applying part including two electrodes across which an electric voltage may be applied in order to generate an electric field between the two electrodes thereby deflecting a trajectory of the ionized gas cluster, the electrodes including one of an opening and a void; and a plate opening that allows the ionized gas cluster whose trajectory is deflected by the electric field applying part to go therethrough.

A second aspect of the present provides a charged particle separation apparatus according to the first aspect, wherein the one of the opening and the void is provided along a direction substantially orthogonal to a direction in which the ionized gas cluster moves.

A third aspect of the present invention provides a charged particle separation apparatus according to the first aspect of the present invention, wherein each of the electrodes includes electrically conductive rods that extend in a direction substantially orthogonal to a direction in which the ionized gas cluster moves and are arranged along the substantially orthogonal direction.

A fourth aspect of the present invention provides a charged particle separation apparatus according to the third aspect, wherein a value of D/P is one or more where P is a pitch of the electrically conductive rods constituting each of the electrodes and D is a distance between the electrodes.

A fifth aspect of the present invention provides a charged particle separation apparatus according to the first or the second aspect, wherein the electrodes include mesh-like plates.

A sixth aspect of the present invention provides a charged particle separation apparatus according to any one of the first through the fifth aspects, further comprising an additional one or more of the electric field applying part.

A seventh aspect of the present invention provides a charged particle bombardment apparatus that includes a gas cluster generation part that generates a gas cluster; an ionizing electrode that ionizes the gas cluster generated by the gas cluster generation part; acceleration electrodes that accelerate the ionized gas cluster; a charged particle separation apparatus according to the first aspect that separates an ionized gas cluster having a desired valence number among the ionized gas clusters accelerated by the acceleration electrodes, wherein the ionized gas cluster emitted from the charged particle separation apparatus is bombarded onto an object.

According to an embodiment of the present invention, a charged particle separation apparatus and a charged particle bombardment apparatus that enable appropriate separation of ionized gas clusters depending on a mass or a valence of the ionized gas clusters are provided.

DETAILED DESCRIPTION OF THE PREFERRED EMBODIMENT

Figure 1:
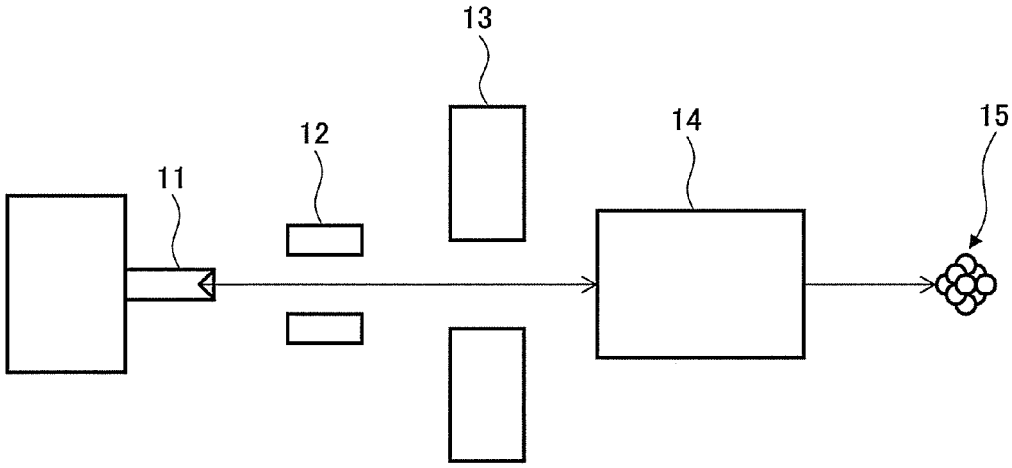
FIG. 1 is a schematic view of a charged particle bombardment apparatus according to an embodiment of the present invention.

Non-limiting, exemplary embodiments of the present invention will now be described with reference to the accompanying drawings. In the drawings, the same or corresponding reference symbols are given to the same or corresponding members or components.

(First Embodiment)

Referring to FIG. 1, a charged particle bombardment apparatus according to a first embodiment of the present invention is explained in the following. A charged particle bombardment apparatus according to this embodiment includes a nozzle part 11, ionization electrodes 12, acceleration electrodes 13, and a gas cluster separating part that corresponds to a charged particle separation apparatus according to this embodiment.

The nozzle part 11 generates gas clusters from pressurized gas. Specifically, gas supplied at a high pressure to the nozzle part 11 is jetted out from the nozzle part 11, and thus the gas clusters are generated. The gas used is a substance in gas phase at normal temperatures, and is preferably argon gas, oxygen gas, or the like.

By supplying, for example, argon gas, the argon gas clusters are generated. These gas clusters do not have the same number of argon atoms, but have various numbers of the argon atoms.

The generated gas clusters are ionized by the ionization electrodes 12, and thus ionized gas clusters are generated. The ionized gas clusters do not have a constant valence number, but may be univalent, divalent, trivalent, or the like.

Next, the ionized gas clusters are accelerated by the acceleration electrodes 13. At this time, the ionized gas cluster is accelerated inversely proportional to a square root of the number of the atoms constituting the gas cluster or a square root of a mass of the gas cluster. In addition, the gas cluster is accelerated proportional to a square root of the valence number of the ionization.

Next, the gas clusters are separated depending on the valence number of the gas clusters by the gas cluster separating part 14. In this embodiment, only a univalent ionized gas cluster 15 can be separated.

Incidentally, although a method of separating the ionized gas cluster 15 depending on the valence number is explained in this embodiment, the ionized gas cluster 15 obtained in the same apparatus configuration can be separated depending on the mass of the ionized gas cluster 15, in other embodiments.

Figure 2:
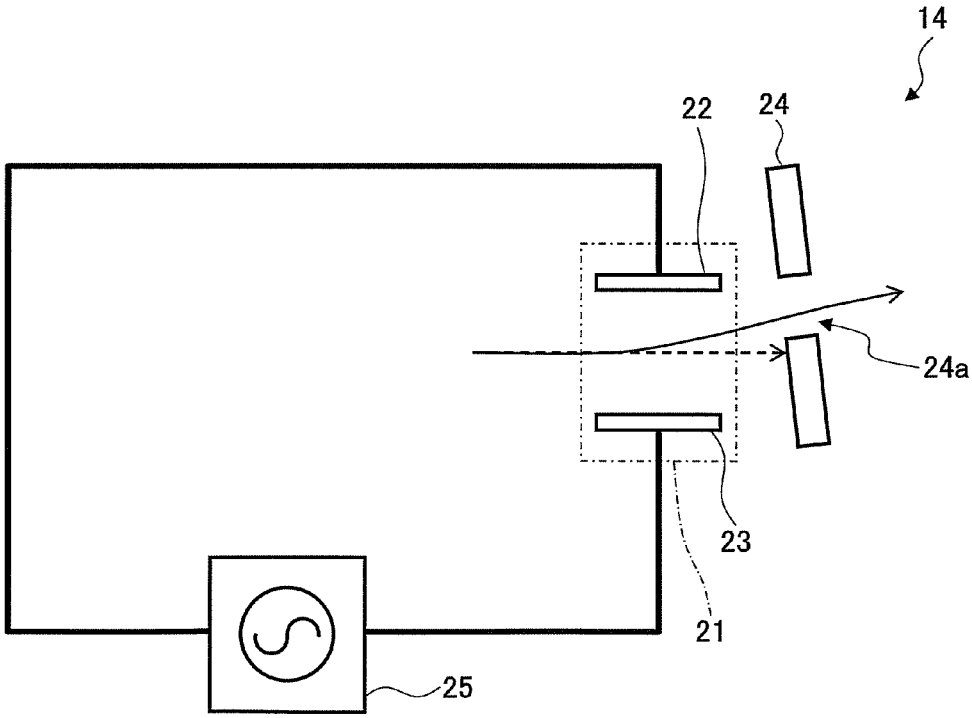
FIG. 2 is a schematic view of a charged particle separation apparatus according to an embodiment of the present invention.

The gas cluster separating part 14 is explained, with reference to FIG. 2, which schematically illustrates the gas cluster separating part 14.

The gas cluster separating part 14 in this embodiment includes an electric field applying part 21, a plate 24, and an electric power source 25.

The electric field applying part 21 includes electrodes 22, 23. When an electric voltage is applied across the electrodes 22, 23, an electric field is generated between the electrodes 22, 23.

In fact, alternating electric voltage is applied across the electrodes 22, 23 by the electric power source 25 in such a manner that electric potentials applied to the electrodes 22, 23 are opposite in phase or 180° phase-shifted. A frequency and an amplitude of the alternating electric voltage may be adjusted by the electric power source 25 so that the gas cluster whose trajectory is deflected can pass through an opening 24*a* (described later) of the plate 24.

The plate 24 has the opening 24*a*, so that the gas clusters whose trajectories are deflected by the electric field applying part 21, among the gas clusters that have come into a space between the electrodes 22, 23, can go through the opening 24*a*. As shown by a dotted arrow in FIG. 2, a gas cluster that moves straight through the space between the electrodes 22, 23 is blocked by the plate 24 and cannot go through the opening 24*a*. In other words, the gas clusters whose trajectories are appropriately deflected by the electric field applying part 21 as shown by a solid arrow in FIG. 2 can be separated from other gas clusters.

Figure 3:
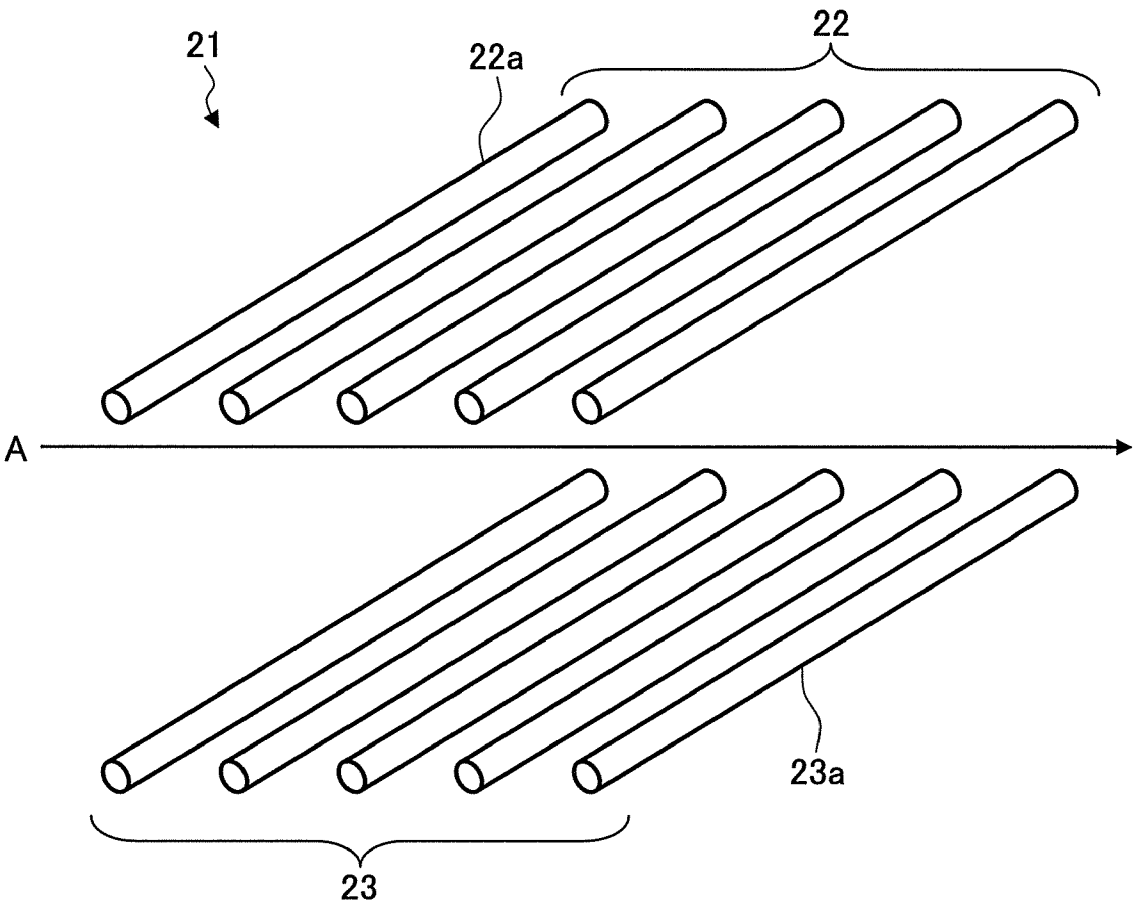
FIG. 3 is a perspective view of electrodes in the charged particle separation apparatus according to the embodiment of the present invention.

As shown in FIG. 3, the electrodes 22, 23 of the electric field applying part 21 are configured of plural electrically conductive rods, which are made of an electrically conductive material such as metal, arranged side by side. Specifically, the electrode 22 includes plural electrically conductive rods 22*a* arranged substantially in parallel with one another, and the electrode 23 includes plural electrically conductive rods 23*a* arranged substantially in parallel with one another. Each of the electrically conductive rods 22*a* extends in a direction substantially orthogonal to a direction along which an ionized gas cluster moves as shown by an arrow A in FIG. 3, and the electrically conductive rods 22*a* are arranged in the direction indicated by the arrow A. Similarly, each of the electrically conductive rods 23*a* extends in the direction substantially orthogonal to the direction along which an ionized gas cluster moves, and the electrically conductive rods 23*a* are arranged in the direction indicated by the arrow A. With such arrangements of the electrically conductive rods 22*a*, 23*a*, the electric field is uniformly generated between the electrodes 22, 23 under predetermined conditions.

Figure 4:
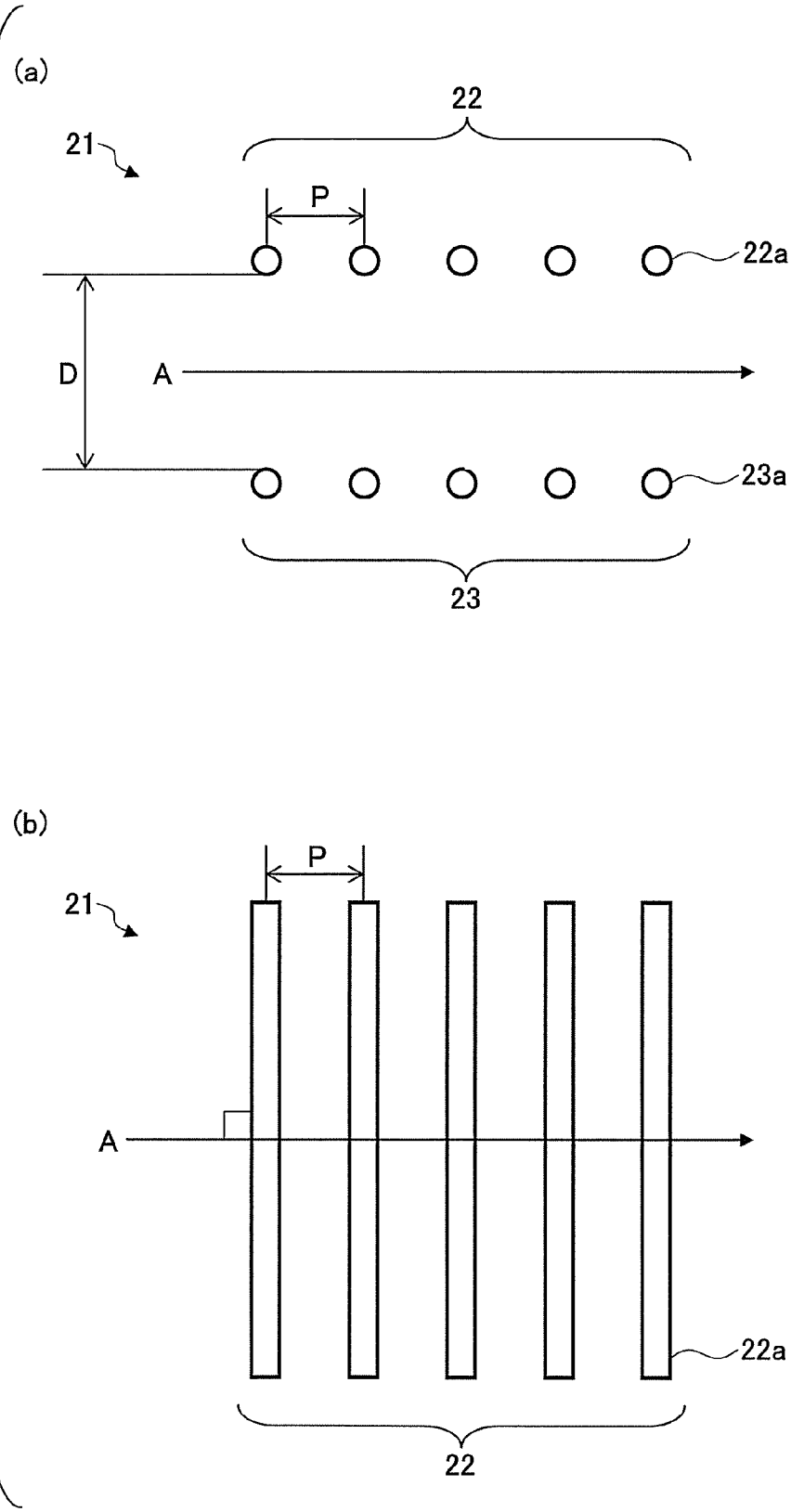
FIG. 4 is a schematic view of the electrodes in the charged particle separation apparatus according to the embodiment of the present invention.

Next, electric field distributions depending on the arrangements of the electrically conductive rods 22*a*, 23*a* are explained with reference to FIG. 4. It is assumed that the electrically conductive rods 22*a* of the electrode 22 are arranged at a pitch of P with one another as shown in subsections (a) and (b) of FIG. 4, and away from the corresponding electrically conductive rods 23*a* of electrode 23 with a distance D as shown in a subsection (a) of FIG. 4. In addition, it is assumed that the electrically conductive rods 23*a* of the electrode 23 are arranged at the same pitch of P.

Figure 5:
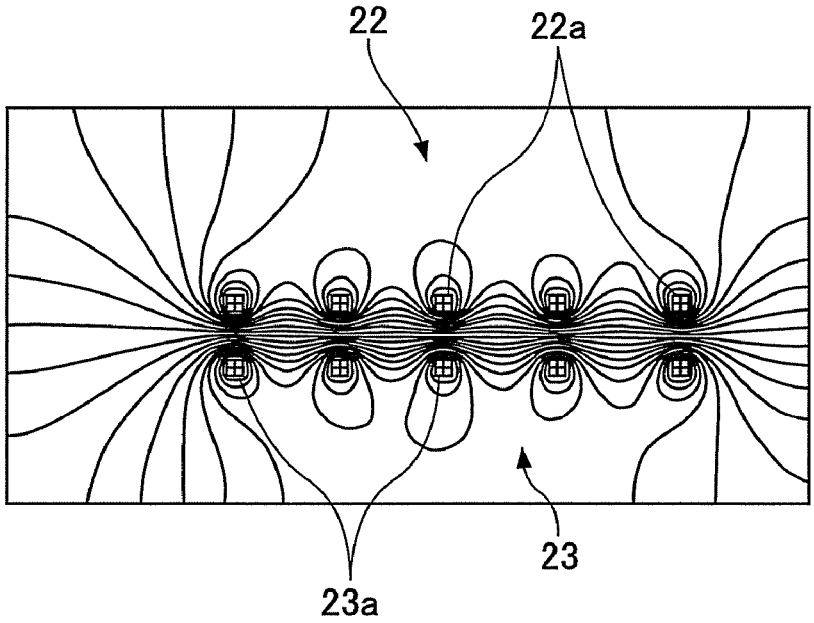
FIG. 5 illustrates a distribution of an electric field generated by the electrodes in the charged particle separation apparatus according to the embodiment of the present invention.

FIG. 5 illustrates a distribution of an electric field generated between the electrodes 22, 23, wherein the electrically conductive rods 22*a*, 23*a* are arranged so that a ratio of D/P is 0.5, when a positive electric potential is applied to one of the electrodes 22, 23 and a negative electric potential is applied to the other one of the electrodes 22, 23. As shown, the electric field is disturbed especially between the electrically conductive rods 22*a* and the corresponding electrically conductive rods 23*a*. In this situation, it is thought that trajectories of the ionized gas clusters cannot be appropriately deflected by the electric field.

Figure 6:
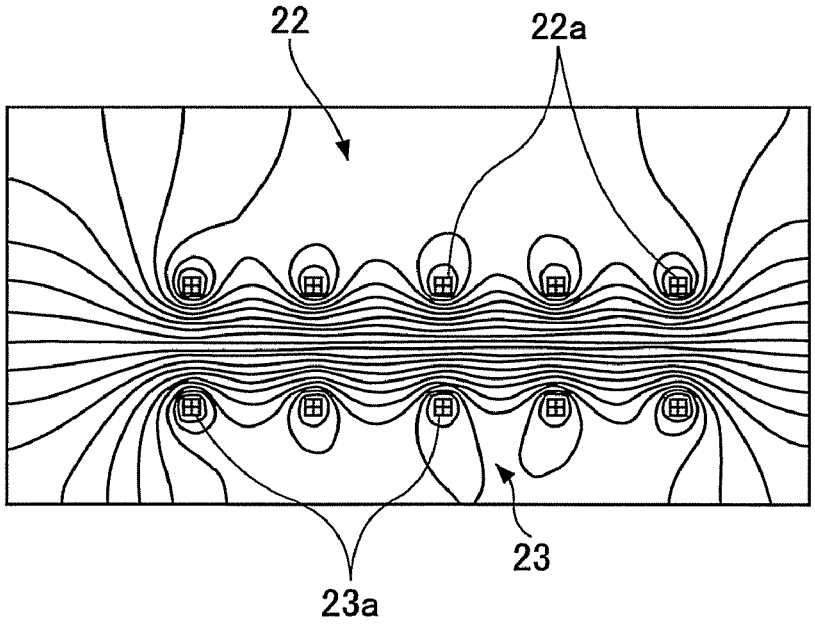
FIG. 6 illustrates another distribution of an electric field generated by the electrodes in the charged particle separation apparatus according to the embodiment of the present invention.

FIG. 6 illustrates a distribution of an electric field generated between the electrodes 22, 23, where the electrically conductive rods 22*a*, 23*a* are arranged so that a ratio of D/P is 1, when a positive electric potential is applied to one of the electrodes 22, 23 and a negative electric potential is applied to the other one of the electrodes 22, 23. As shown, the electric field is relatively uniformly distributed between the electrodes 22, 23, while being slightly disturbed around the electrically conductive rods 22*a*, 23*a*. In this situation, it is thought that trajectories of the ionized gas clusters can be appropriately deflected by the electric field.

Figure 7:
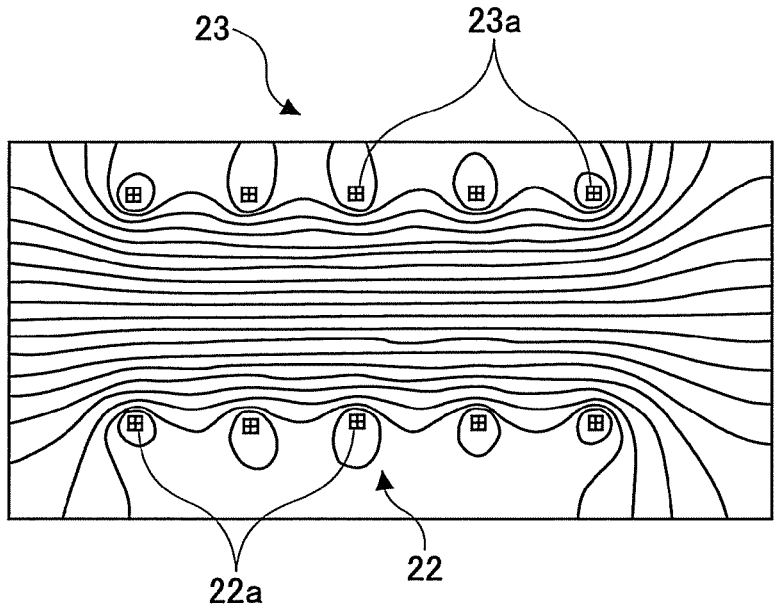
FIG. 7 illustrates yet another distribution of an electric field generated by the electrodes in the charged particle separation apparatus according to the embodiment of the present invention.

FIG. 7 illustrates a distribution of an electric field generated between the electrodes 22, 23, where the electrically conductive rods 22*a*, 23*a* are arranged so that a ratio of D/P is 2, when a positive electric potential is applied to one of the electrodes 22, 23 and a negative electric potential is applied to the other one of the electrodes 22, 23. As shown, the electric field is substantially uniformly distributed between the electrodes 22, 23. In this situation, it is thought that trajectories of the ionized gas clusters can be appropriately deflected by the electric field.

Figure 8:
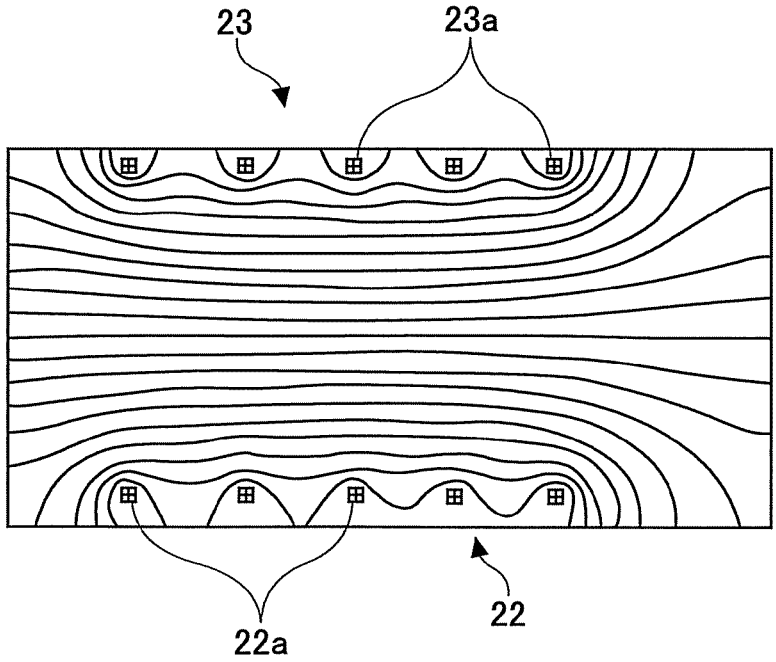
FIG. 8 illustrates still another distribution of an electric field generated by the electrodes in the charged particle separation apparatus according to the embodiment of the present invention.

FIG. 8 illustrates a distribution of an electric field generated between the electrodes 22, 23, where the electrically conductive rods 22*a*, 23*a* are arranged so that a ratio of D/P is 2.5, when a positive electric potential is applied to one of the electrodes 22, 23 and a negative electric potential is applied to the other one of the electrodes 22, 23. As shown, the electric field is more uniformly distributed between the electrodes 22, 23. In this situation, it is thought that trajectories of the ionized gas clusters can be appropriately deflected by the electric field.

From the foregoing explanations, the electric field can be uniformly distributed between the electrodes 22, 23 when the ratio of D/P is 1 or more, and thus the trajectories of the ionized gas clusters can be appropriately deflected.

In addition, because the electrodes 22, 23 include the electrically conductive rods 22*a*, 23*a* arranged at predetermined pitches, respectively, in this embodiment, an area near the electrode 22 (or 23) can be evacuated through spaces (voids) between the electrically conductive rods 22*a* (or 23*a*), even if an evacuation mechanism is provided in a chamber where the electrodes 22, 23 are accommodated. Therefore, the electrodes 22, 23 do not affect the evacuation or impair smooth separation of ionized gas clusters.

(Second Embodiment)

Next, a second embodiment of the present invention is explained. In this embodiment, an electric field applying part of the gas cluster separating part 14 includes mesh-like electrodes.

Figure 9:
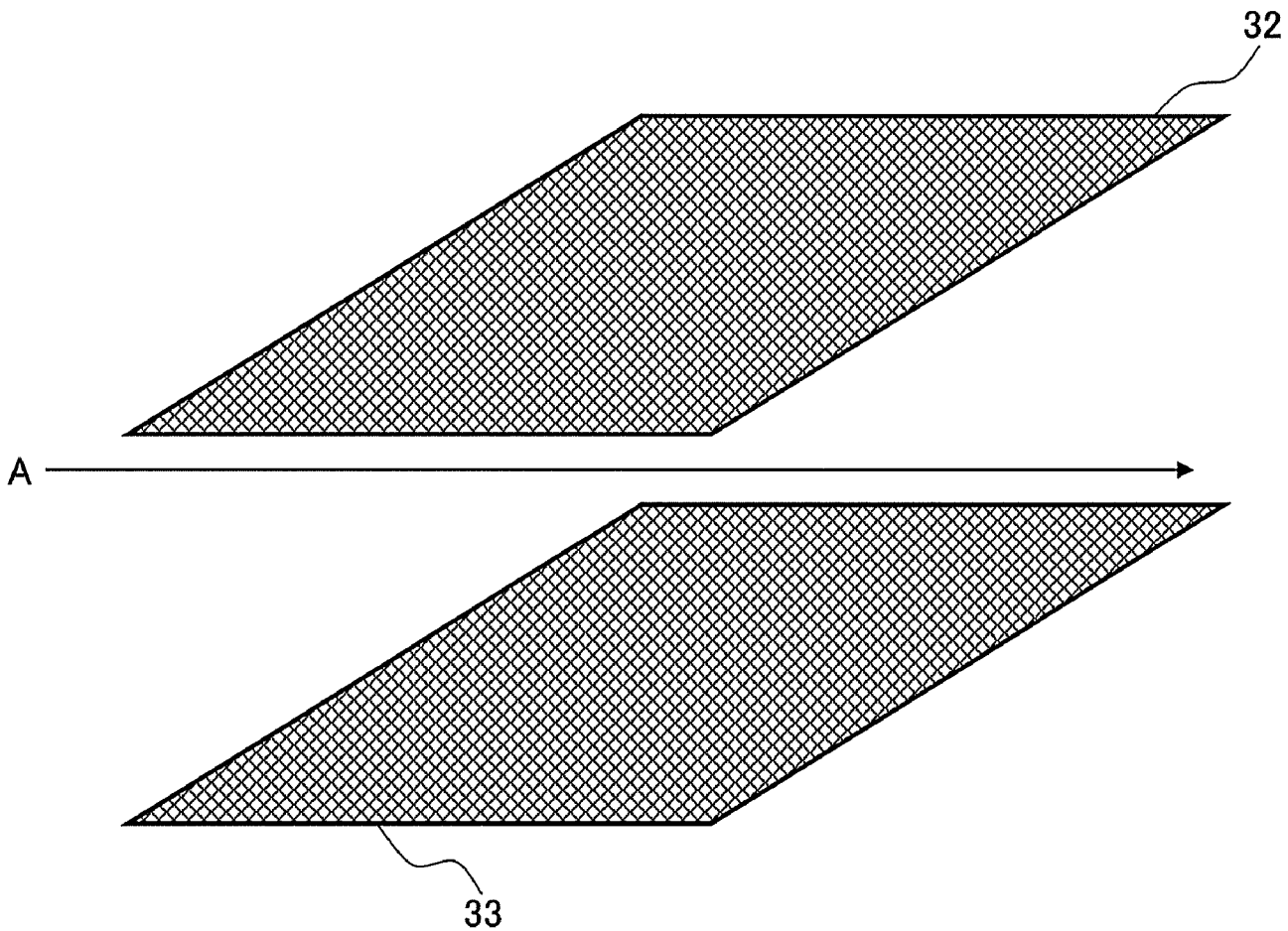
FIG. 9 is a perspective view of electrodes in a charged particle separation apparatus according to another embodiment of the present invention.

FIG. 9 illustrates electrodes of the electric field applying part in this embodiment. The electric field applying part includes mesh-like electrodes 32, 33, each of which is made of fine wires of copper or the like arranged in a matrix in a plane. By applying an electric voltage across the mesh-like electrodes 32, 33, the electric field is generated between the mesh-like electrodes 32, 33.

Because the mesh-like electrodes 32, 33 have openings defined by the fine wires arranged in a matrix in a plane, the electrodes 32, 33 do not affect the evacuation or impair smooth separation of ionized gas clusters.

The electric field applying part in this embodiment can be used in the same manner as the electric field applying part 21 in the first embodiment. With this, the charged particle separation apparatus that separates the ionized gas clusters and the charged particle bombardment apparatus can be obtained.

(Third Embodiment)

Next, a third embodiment of the present invention is explained. A charged particle separation apparatus and a charged particle bombardment apparatus according to this embodiment include plural electric field applying parts having the electrodes in the first or the second embodiment.

Figure 10:
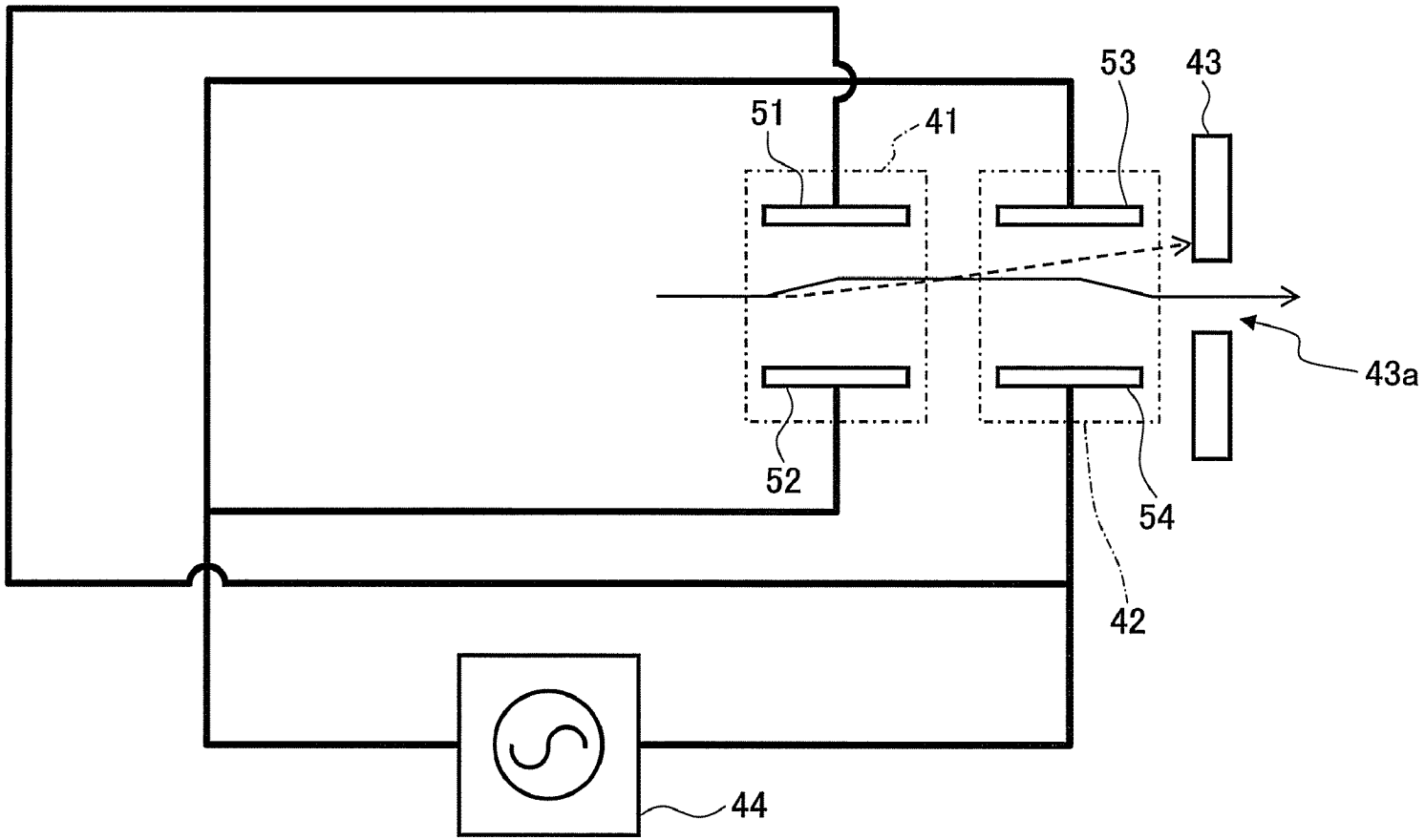
FIG. 10 is a schematic view of a charged particle separation apparatus according to yet another embodiment of the present invention.

FIG. 10 illustrates the charged particle separation apparatus according to this embodiment. This charged particle separation apparatus includes two electric field applying parts 41, 42, a plate 43, and an electric power source 44.

The electric field applying part 41 includes electrodes 51, 52. When an electric voltage is applied across the electrodes 51, 52, an electric field is generated between the electrodes 51, 52. The electric field applying part 42 includes electrodes 53, 54. When an electric voltage is applied across the electrodes 53, 54, an electric field is generated between the electrodes 53, 54.

Alternating electric voltage is supplied from the electric power source 44 to the electric field applying parts 41, 42. The electrodes 51 and 54 are electrically connected, and the electrodes 52 and 53 are electrically connected. The electric power source 44 applies electric potential at the electrodes 52, 53 opposite in phase or 180° phase-shifted in relation to the electric potential applied at the electrodes 51, 54. A frequency and an amplitude of the voltage supplied to the electric field applying parts 41, 42 can be adjusted. In addition, the plate 43 has an opening 43*a* through which the ionized gas clusters moving straight along the electrodes 51 through 54 can go through.

In this charged particle separation apparatus, the electrodes 51, 52, 53, and 54 may include the plural electrically conductive rods in the first embodiment, or may be configured of the mesh-like electrodes in the second embodiment.

With such a configuration, an ionized gas cluster whose trajectory is deflected by the electric field applying parts 41, 42 as shown by a dotted line cannot go through the opening 43*a* of the plate 43 and is blocked by the plate 43 in FIG. 10. Therefore, the charged particle separation apparatus according to this embodiment can separate only the ionized gas clusters moving straight as shown by a solid line in FIG. 10.

Figure 11:
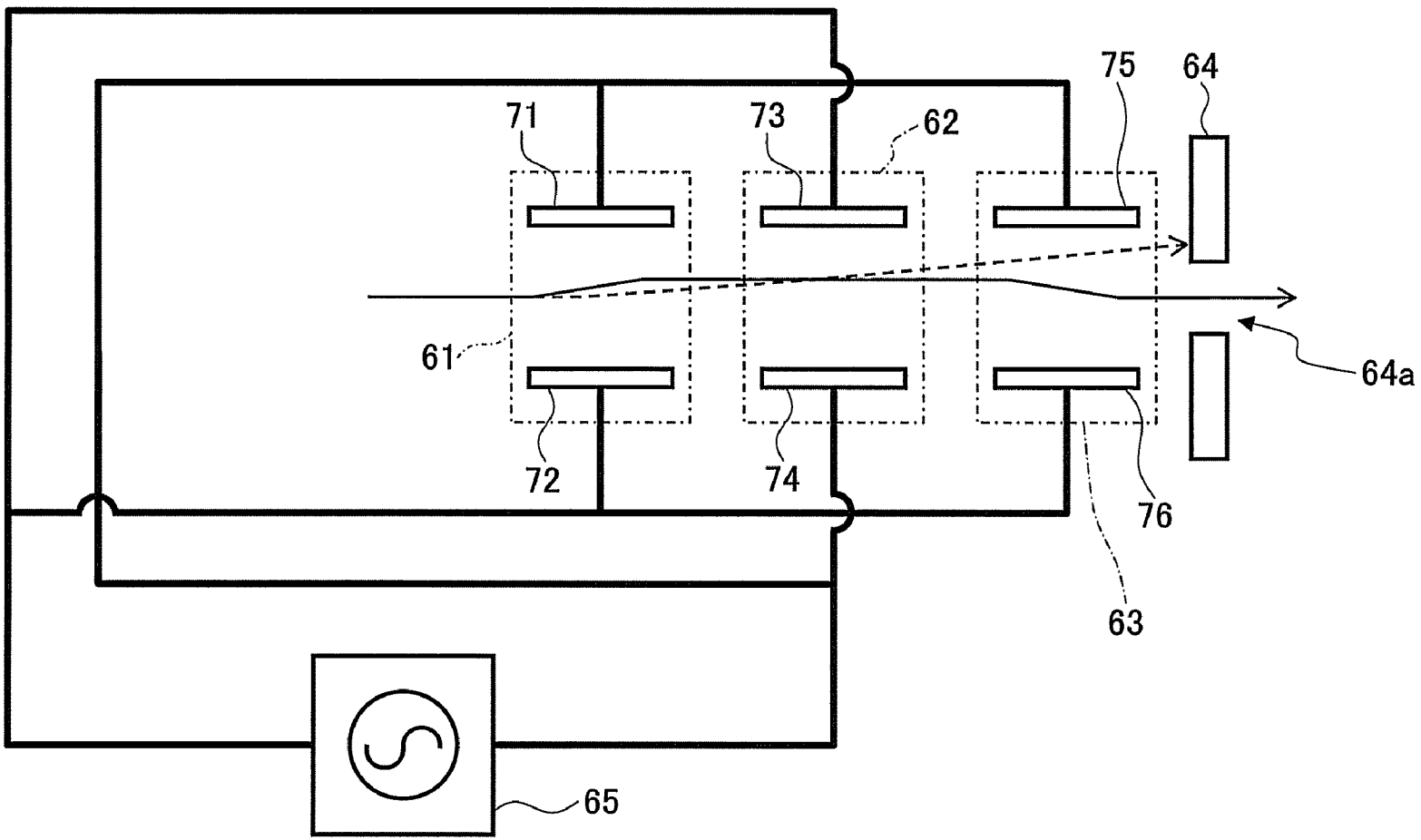
FIG. 11 is a schematic view of a modified example of the charged particle separation apparatus according to the embodiment shown in FIG. 10.

Another configuration of the charged particle separation apparatus according to this embodiment is illustrated in FIG. 11. This charged particle separation apparatus includes three electric field applying parts 61, 62, 63, a plate 64, and an electric power source 65.

The electric field applying part 61 includes electrodes 71, 72, and an electric field is generated between the electrodes 71, 72 by applying a voltage across the electrodes 71, 72. The electric field applying part 62 includes electrodes 73, 74, and an electric field is generated between the electrodes 73, 74 by applying voltage across the electrodes 73, 74. The electric field applying part 63 includes electrodes 75, 76, and an electric field is generated between the electrodes 75, 76 by applying voltage across the electrodes 75, 76.

Alternating electric voltage is supplied from the electric power source 65 to the electric field applying parts 61, 62, 63. The electrodes 71, 74, and 75 are electrically connected, and the electrodes 72, 73, and 76 are electrically connected. The electric power source 65 applies an electric potential at the electrodes 72, 73, 76 opposite in phase or 180° phase-shifted in relation to the electric potential applied at the electrodes 71, 74, 75. A frequency and an amplitude of the voltage supplied to the electric field applying parts 61, 62, 63 can be adjusted. In addition, the plate 64 has an opening 64*a* through which the ionized gas clusters moving straight through the electric field applying parts 61, 62, 63 can go.

In this charged particle separation apparatus, the electrodes 71, 72, 73, 74, 75, and 76 may include the plural electrically conductive rods in the first embodiment, or may be configured of the mesh-like electrodes in the second embodiment.

With such a configuration, an ionized gas cluster whose trajectory is deflected by the electric field applying parts 61, 62, 63 as shown by a dotted line cannot go through the opening 64*a* of the plate 64 and is blocked by the plate 64 in FIG. 11. Therefore, the charged particle separation apparatus according to this embodiment can separate only the ionized gas clusters moving straight as shown by a solid line in FIG. 11.

Figure 12:
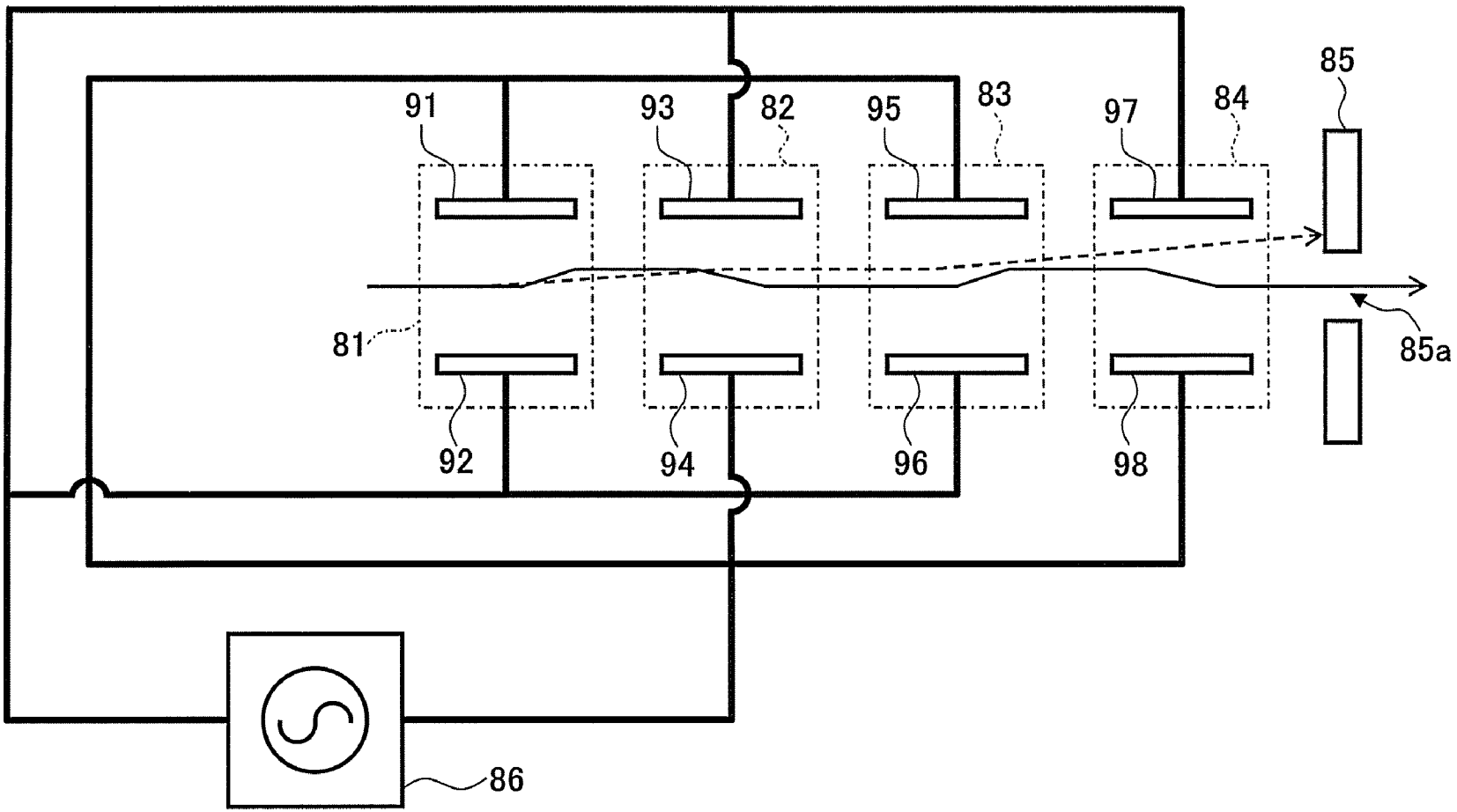
FIG. 12 is a schematic view of another modified example of the charged particle separation apparatus according to the embodiment shown in FIG. 10.

Yet another configuration of the charged particle separation apparatus according to this embodiment is illustrated in FIG. 12. This charged particle separation apparatus includes four electric field applying parts 81, 82, 83, 84, a plate 85, and an electric power source 86.

The electric field applying part 81 includes electrodes 91, 92, and an electric field is generated between the electrodes 91, 92 by applying a voltage across the electrodes 91, 92. The electric field applying part 82 includes electrodes 93, 94, and an electric field is generated between the electrodes 93, 94 by applying a voltage across the electrodes 93, 94. The electric field applying part 83 includes electrodes 95, 96, and an electric field is generated between the electrodes 95, 96 by applying a voltage across the electrodes 95, 96. The electric field applying part 84 includes electrodes 97, 98, and an electric field is generated between the electrodes 97, 98 by applying a voltage across the electrodes 97, 98.

Alternating electric voltage is supplied from the electric power source 65 to the electric field applying parts 81, 82, 83, 84. The electrodes 91, 94, 95, and 98 are electrically connected, and the electrodes 92, 93, 94, and 97 are electrically connected. The electric power source 86 applies electric potential at the electrodes 92, 93, 94, 97 opposite in phase or 180° phase-shifted in relation to the electric potential at the electrodes 91, 94, 95, 98. A frequency and an amplitude of the voltage supplied to the electric field applying parts 81, 82, 83, 84 can be adjusted. In addition, the plate 85 has an opening 85*a* through which the particles moving straight through the electric field applying parts 81, 82, 83, 84 can go.

In this charged particle separation apparatus, the electrodes 91, 92, 93, 94, 95, 96, 97, 98 may include the plural electrically conductive rods in the first embodiment, or may be configured of the mesh-like electrodes in the second embodiment.

With such a configuration, an ionized gas cluster whose trajectory is deflected by the electric field applying parts 81, 82, 83, 84 as shown by a dotted line cannot go through the opening 85*a* of the plate 85 and is blocked by the plate 85 in FIG. 12. Therefore, the charged particle separation apparatus according to this embodiment can separate only the gas clusters moving straight as shown by a solid line in FIG. 12.

In this embodiment, even when the plural electric field applying parts are provided, or the number of the electrodes is increased, the electrodes do not affect the evacuation, and thus trajectories of the ionized gas clusters can be appropriately deflected.

Although several embodiments according to the present invention have been explained, the present invention is not limited to the disclosed embodiments, but may be modified or altered within the scope of the accompanying claims.

What is claimed is:

1. A charged particle separation apparatus that separates ionized gas clusters, the charged particle separation apparatus comprising:

an electric field applying part including two electrodes across which an electric voltage may be applied in order to generate an electric field between the two electrodes thereby deflecting a trajectory of the ionized gas cluster, the electrodes including one of an opening and a void; and a plate opening that allows the ionized gas cluster whose trajectory is deflected by the electric field applying part to go therethrough.

2. The charged particle separation apparatus recited in claim 1, wherein the one of the opening and the void is provided along a direction substantially orthogonal to a direction in which the ionized gas cluster moves.

3. The charged particle separation apparatus recited in claim 1, wherein each of the electrodes includes electrically conductive rods that extend in a direction substantially orthogonal to a direction in which the ionized gas cluster moves, and are arranged along the substantially orthogonal direction.

4. The charged particle separation apparatus recited in claim 3, wherein a value of D/P is one or more where P is a pitch of the electrically conductive rods constituting each of the electrodes and D is a distance between the electrodes.

5. The charged particle separation apparatus recited in claim 1, wherein the electrodes include meshed plates.

6. The charged particle separation apparatus recited in claim 1, further comprising an additional one or more of the electric field applying part.

7. A charged particle bombardment apparatus comprising:

a gas cluster generation part that generates a gas cluster;

an ionizing electrode that ionizes the gas cluster generated by the gas cluster generation part;

acceleration electrodes that accelerate the ionized gas cluster; and a charged particle separation apparatus recited in claim 1 that separates an ionized gas cluster having a desired valence number among the ionized gas clusters accelerated by the acceleration electrodes, wherein the ionized gas cluster emitted from the charged particle separation apparatus is bombarded onto an object.

* * * * *